US005925311A

United States Patent [19]

Peñafiel Vercher et al.

[11] Patent Number: 5,925,311

[45] Date of Patent: Jul. 20, 1999

[54] SYSTEM FOR INCORPORATING A BINDER IN A MIXTURE OF POWDERED MATERIALS AND APPARATUS THEREFOR

[75] Inventors: Jesús Peñafiel Vercher, Sant Joan Despi; César Molins Bartra, Cabrils; José Rafanell Alberch, Barcelona, all of Spain

[73] Assignee: Aleaciones de Metales Sinterizados S.A. (AMES S.A.), Barcelona, Spain

[21] Appl. No.: 08/965,046

[22] Filed: Nov. 5, 1997

[30] Foreign Application Priority Data

Nov. 6, 1996 [ES] Spain ..... 9602338

[51] Int. Cl.[6] ..... B01F 13/06

[52] U.S. Cl. ..... 266/114; 266/252; 366/139; 366/228

[58] Field of Search ..... 266/114, 252, 266/255; 366/139, 228; 419/64, 65, 62

[56] References Cited

U.S. PATENT DOCUMENTS 4,388,088 6/1983 Rozmus, Jr. et al. ..... 419/64

4,430,003 2/1984 Beattie et al. ..... 366/228

4,571,089 2/1986 Gudlauski et al. ..... 366/139

4,940,337 7/1990 Nakaji et al. ..... 366/228

*Primary Examiner*—Scott Kastler

*Attorney, Agent, or Firm*—Sughrue, Mion, Zinn, Macpeak & Seas, PLLC

[57] ABSTRACT

A mixture of powdered materials is subjected in an enclosure to a dispersing movement such that the components of the mixture are caused to fall freely in a dispersed form. During the fall, the dispersed components are sprayed with a binder dissolved in a solvent. On completion of the spraying, the dispersing movement is continued and a vacuum is simultaneously drawn in the vessel until the binder is in a solid state. In this way, the solvent is recovered in part. The apparatus includes a closed rotary vessel, inside of which are a suction conduit and a spray conduit, extending into the vessel in alignment with the axis thereof; the conduits are prolonged in respective vertical portions capped with a suction head and a spray head.

9 Claims, 3 Drawing Sheets

SYSTEM FOR INCORPORATING A BINDER IN A MIXTURE OF POWDERED MATERIALS AND APPARATUS THEREFOR

FIELD OF THE INVENTION

The invention relates to a system for incorporating a binder in a mixture of powdered materials, applicable in powder metallurgy, said mixture comprising at least two components and said binder being soluble in a solvent in which said components are insoluble. Therefore, the invention is related to the preparation of sintered parts.

The invention also relates to an apparatus for incorporating a binder in a mixture of powdered materials, applicable in powder metallurgy.

PRIOR ART REFERENCE

Spanish patent 9401273 discloses the preparation of the said compositions and the formation of the composition itself. According to that document, a composition of the type referred to comprises essentially: a base powder, a certain amount of at least some alloying powders or components and a binder, selected from among the solid fatty acids, solid esters thereof and mixtures of the ones or the others or of both, alone or together with a natural or synthetic resin, i.e., a polymer.

The said composition is formed by mechanical mixing of the base powder and the alloying components, the binder having been added in the form of a solution in an organic solvent.

The thus obtained composition withstands segregation of the components and affords a good flowability of the overall mixture.

The binder must be distributed throughout the mixture forming a continuous film adhered to all the surface of the base powder particles, which consolidates after removal of the solvent. This film volatilizes during the sintering step, without leaving carbonaceous or metallic residues in the resulting end part.

In practice, it is extremely time-consuming to achieve a homogenous distribution of the binder so that the solution thereof wets all the powder particles of the mixture.

SUMMARY OF THE INVENTION

It is an object of this invention to overcome the above drawback, whereby a system would be desirable which allowed the binder to envelop all or a major portion of the surface of each and every one of the base powder particles.

This object is achieved by a system of the type first mentioned above wherein said powder mixture is subjected in an enclosure to a dispersing movement causing an uninterrupted free fall in the disperse form of said components of said mixture; said disperse components being subjected in said free fall to a spray of said binder dissolved in said solvent; said dispersing movement continuing after completion of said spray; a vacuum being created in said enclosure during said continued movement which continues until said binder is in a solid state, with the consequent recovery of a substantial portion of said solvent.

With the above system, the dissolved binder is applied to the components of the mix in such a way that the particles of these components are substantially discrete from one another during the application of the binder.

The apparatus of the invention comprises a closed vessel, provided with at least one charging and/or discharge port, said vessel being rotatory in a first direction of rotation about an ideal horizontal axis crossing therethrough; and comprising in the interior thereof a suction conduit which extends into the vessel from the outside thereof in a first direction aligned with said axis and a spray conduit, which extends into the vessel from the outside thereof in a second direction aligned with said axis and opposite to said first direction; said conduits facing each other in a central region, in which said conduits are prolonged respectively in a first vertical portion capped with a suction head and a second vertical portion capped with a spray head; the arrangement being such that said conduits and said heads do not intercept said rotation of said vessel.

BRIEF DESCRIPTION OF THE DRAWING

Further features and details will be disclosed in the description which, to facilitate an understanding of the foregoing ideas, is developed hereinafter with reference to the accompanying illustrative drawings, in which.

DESCRIPTION OF ONE EMBODIMENT OF THE INVENTION

The invention is related to the preparation of sintered parts. The system of the invention starts out from a mixture of powdered materials comprising preferably base powders (i.e. iron, copper, bronze or other powders forming the fundamental elements in the sintering operation) and alloying powders (i.e. other powdered materials which are included in minor amounts to obtain certain characteristics); the system consists of subjecting the said mixture of materials in an enclosure to a dispersing movement which causes an uninterrupted free fall of the mixture components in disperse form, during which such components are subjected, in turn, to a spray of a binder dissolved in a solvent in which the mixture components are insoluble.

The said dispersing movement to which the components of the material mixture are subjected may consist of a controlled speed tumbling of the enclosure, beating of the mixture by blades, helical augers or the like, vibrating of the mixture advancing on an apron from which it is precipitated in disperse form as a rain at the end thereof, etc.

The binder is sprayed until the amount intended to be incorporated in the mixture is exhausted.

Thereafter, without interrupting the dispersing movement, a vacuum is applied to the interior of the enclosure until the major portion of the solvent used has been recovered and a homogenous mixture of the initial components of the mix and the binder has been obtained, the latter as a solid coating of the particles of those components.

The spraying operation is effected in the same direction as the free fall of the disperse component particles in their movement within the enclosure.

The vacuum is created by suction in the opposite direction to the free fall of the disperse component particles of the mixture, in their movement within the enclosure.

The system may be put into practice with the use, basically, of the conventional powder mixers, such as the symmetrical or asymmetrical biconical mixers, the pyramidal, the V-shaped and Y-shaped mixers.

Figure 1:
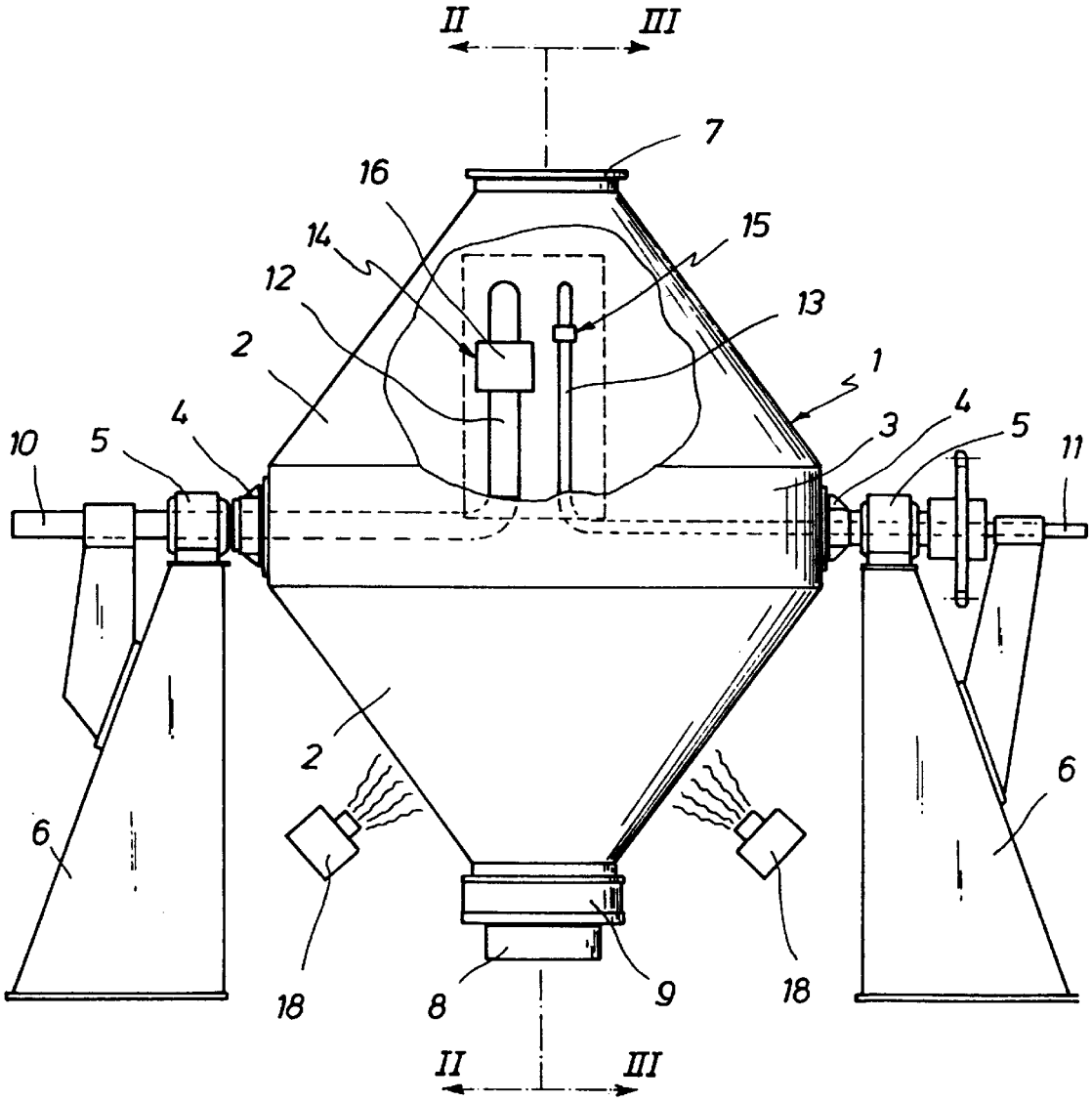
FIG. 1 is a schematic front elevation view, partly in cross section, of one embodiment of the apparatus for carrying out the system of the invention.

One embodiment of an apparatus for carrying out the system comprises a symmetrical biconical mixer, as shown in FIG. 1, consisting of a vessel 1, formed by two frusto-conical bodies 2 which are attached together at the larger ends thereof by a central cylindrical body 3 and which may rotate about an ideal horizontal axis extending across two ends 4 of a maximum diameter, journalled in bearings 5 mounted in stands 6. The smaller ends form a charging port 7 and another discharge port 8, the latter having a valve 9.

In the vessel 1 there is a suction conduit 10 and a spray conduit 11 which extend into the vessel 1 from the outside thereof in respective directions aligned with the axis of ends 4, although both directions are opposite to each other. They meet in a center region from where they form an elbow and are respectively prolonged in a first vertical portion 12, capped with a suction head 14 and a second vertical portion 13 capped with a spray head 15.

Figure 2:
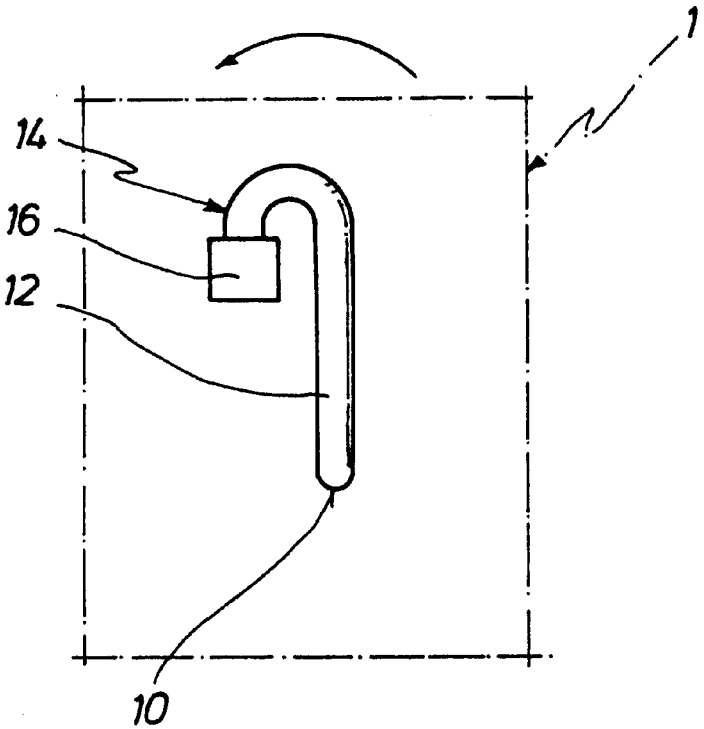
FIG. 2 is a schematic view of the suction head in the direction of the arrows II—II of FIG. 1.

The suction head 14 (FIG. 2) is formed by a hollow body 16 open downwardly and in communication upwardly with the first vertical portion 12 through a first elbow. In the direction of rotation (illustrated by a curved arrow) of the vessel 1, the first vertical portion 12 precedes the hollow body 16 so that the disperse components of the mix strike against the wall of the hollow body 16 (FIG. 5) without reaching the port thereof during the dispersing movement to which they are subjected.

Figure 3:
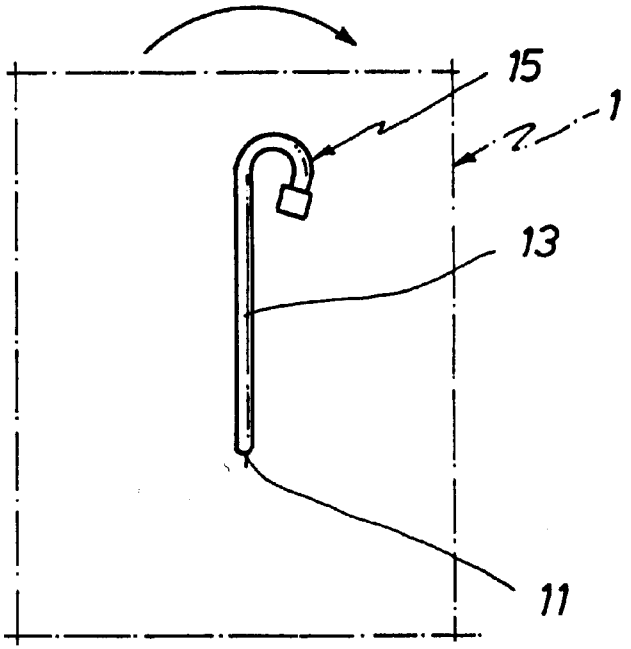
FIG. 3 is a schematic view of the spray head in the direction of the arrows III—III of FIG. 1.

The spray head 15 (FIG. 3) comprises at least one downwardly directed sprinkler which is connected upwardly through a second elbow with the second vertical portion 13 of the prolongation of the spray tube 11. In this case also, in the direction of rotation (illustrated by the curved arrow) of the vessel 1, the second vertical portion 13 precedes the spray head, so that the disperse components of the mix are reached by the binder spray during the free fall thereof caused by the dispersing movement to which they are subjected.

The spray head 15 may be provided with means to prevent the sprinkler being directly contacted by the disperse components during the free fall of the latter and becoming blocked.

The vessel 1 is provided with means for heating the mass contained therein, such as gas burners 18 or other heating means (electric, steam, oil, etc.).

The suction conduit 10 is connected to a vacuum pump through a cyclone and condenser collector of the recovered solvent, not shown.

In turn, the spray conduit 11 is connected to a binder solution batching device which, in turn, is connected to a reservoir wherein the solution is formed and with a compressed air source to move the solution from the reservoir and inject it in spray form into the closed vessel 1. These items have not been illustrated either, in view of their obviousness.

In conformity with the foregoing, the binder solution is incorporated in the insoluble powder mixture as follows:

A certain amount of base and alloying powders, in the required proportions, is charged, with or without the powdered lubricant, into the closed vessel 1 through the charging port 7 thereof to form a mixture.

Thereafter, the closed vessel 1 is set in motion about the ideal axis of rotation thereof, whereby the mixture mass is tumbled with each rotation of the vessel, in such a way that a part of the upper layer of the mass is thrown off by inertia and tipping towards an opposite region in disperse or rainlike form, with uninterrupted free fall in the direction of rotation of the vessel.

Figure 4:
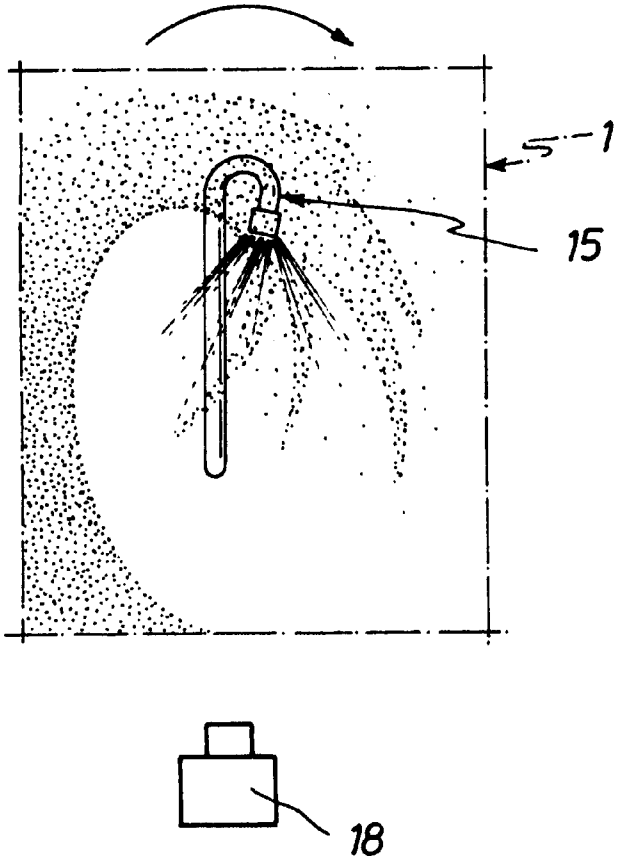
FIG. 4 is a schematic view of the spray head of FIG. 3, when spraying the soluble binder on the mixture of powdered materials.

Once the base and alloying powders have been mixed, spraying of the binder solution is initiated, while maintaining rotation of the closed vessel 1, in such a way that said solution wets the particles of the components of the mixture, particularly during the free fall thereof, as may be seen in FIG. 4. Spraying continues until the volume of solution established in terms of the proportion of binder it is desired to have in the final mix is exhausted.

Figure 5:
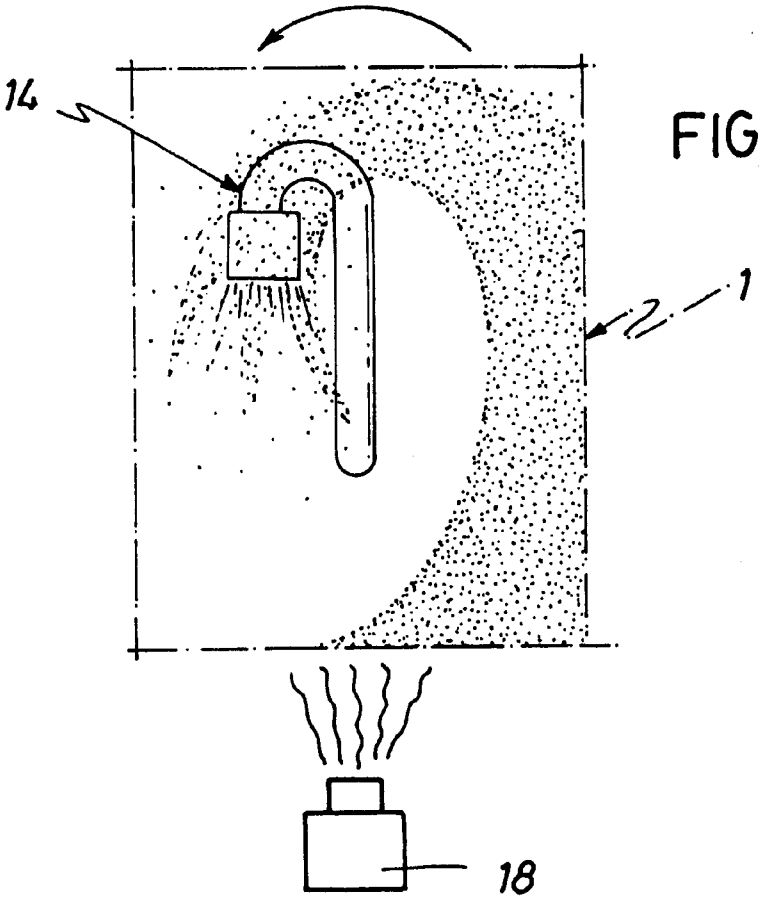
FIG. 5 is a schematic view of the suction head of FIG. 2, when aspirating the solvent from the binder incorporated in the mixture of materials during the spraying step.

Thereafter, while the vessel 1 continues to rotate, as may be seen in FIG. 5, the vacuum is drawn therein through the suction conduit 10, whereby the air is removed from the enclosure, accompanied by the vapors of the solvent used, which is recovered by condensation for reuse. The air is sucked from the enclosure through a cyclone which separates the particles of base and alloying powders which may be entrained during the suction stage. This operation is effected with heating of the mass of the mix by heaters, such as the gas burners 18 or others. This operation continues until the major portion of the solvent has been recovered, whereby the mixture may be deemed to be completely dry and homogenous.

Finally, the heaters are turned off, the rotation of the vessel 1 is stopped and it is emptied through the discharge port 8 thereof.

What we claim is:

1. A system for incorporating a binder in a mixture of powdered materials, applicable in powder metallurgy, said mixture comprising at least two components and said binder being soluble in a solvent in which said components are insoluble, wherein said powder mixture is subjected in an enclosure to a dispersing movement causing an uninterrupted free fall in the disperse form of said components of said mixture; said dispersed components being subjected in said free fall to a spray of said binder dissolved in said solvent; said dispersing movement continuing after completion of said spray; a vacuum being created in said enclosure during said continued movement which continues until said binder is in a solid state, with the consequent recovery of a substantial portion of said solvent.

2. The system of claim 1, wherein said spraying is effected in a direction substantially the same as the direction of free fall of said components of said mixture.

3. The system of claim 1, wherein said vacuum is drawn by suction in a direction substantially opposite to the direction of free fall of said components of said mixture.

4. An apparatus for incorporating a binder in a mixture of powdered materials, applicable in powder metallurgy, the apparatus comprising a closed vessel, provided with at least one charging and/or discharge port, said vessel being rotatory in a first direction of rotation about an ideal horizontal axis crossing therethrough; and comprising in the interior thereof a suction conduit which extends into the vessel from the outside thereof in a first direction aligned with said axis and a spray conduit, which extends into the vessel from the outside thereof in a second direction aligned with said axis and opposite to said first direction; said conduits facing each other in a central region, in which said conduits are prolonged respectively in a first vertical portion capped with a suction head and a second vertical portion capped with a spray head; the arrangement being such that said conduits and said heads do not intercept said rotation of said vessel.

5. The apparatus of claim 4, wherein said suction head is formed by a downwardly open hollow body member communicating upwardly over a first elbow with said first vertical portion.

6. The apparatus of claim 5, wherein in said first direction of rotation, said first vertical portion precedes said hollow body member.

7. The apparatus of claim 4, wherein said spray head comprises at least one downwardly open sprinkler communicating upwardly over a second elbow with said second vertical portion.

8. The apparatus of claim 7, wherein in said first direction of rotation, said second vertical portion precedes said spray head.

9. The apparatus of claim 4, wherein said closed vessel is provided with means for heating the mass contained therein.

* * * * *